US005694691A

United States Patent [19]

Chen

[11] Patent Number: 5,694,691

[45] Date of Patent: Dec. 9, 1997

[54] CIGAR CUTTER

[76] Inventor: Su-Fen Chen, No. 2, Lane 320, Te Feng Road Section 1, Ta Li City, Taichung Hsien, Taiwan

[21] Appl. No.: 709,716

[22] Filed: Sep. 9, 1996

[51] Int. Cl.[6] ..... A24C 5/12

[52] U.S. Cl. ..... 30/112; 30/111; 30/278

[58] Field of Search ..... 30/109, 111, 112, 30/155, 320, 321, 329, 330, 278

[56] References Cited

U.S. PATENT DOCUMENTS

| | | | |
|---|---|---|---|
| 819,875 | 5/1906 | Garrigus | 30/112 |
| 4,447,950 | 5/1984 | Mizelle | 30/155 |
| 4,837,931 | 6/1989 | Beermann | 30/112 |
| 5,495,673 | 3/1996 | Gardiner et al. | 30/155 |

FOREIGN PATENT DOCUMENTS

| | | | |
|---|---|---|---|
| 53166 | 2/1890 | Germany | 30/112 |

*Primary Examiner*—Hwei-Siu Payer

*Attorney, Agent, or Firm*—Charles E. Baxley, Esq.

[57] ABSTRACT

A cigar cutter includes a pair of plates secured together and having a center orifice for engaging with a cigar. A cutting blade is engaged between the plates and pivotally coupled to the plates at a pivot shaft, and includes a cutting edge. The cutting blade is rotatable about the pivot shaft for opening the orifices of the plates and for allowing the cigar to engage into the orifices. The cutting edge of the cutting blade may be moved across the orifices for cutting the cigar. The cigar cutter includes a biasing spring for biasing the cutting blade backward to the storing position. The blade includes a shoulder formed in the peripheral portion for engaging with a stop member and for limiting the rotational movement of the blade relative to the plates.

4 Claims, 5 Drawing Sheets

CIGAR CUTTER

BACKGROUND OF THE INVENTION

1. Field of the Invention

The present invention relates to a cutter, and more particularly to a cutter for cutting cigar.

2. Description of the Prior Art

Typical cigars may not be used up all at once and should be distinguished one or more times for storing purposes. However, the distinguished end of the cigar may pollute the cloth or the cigar receiving box.

The present invention has arisen to mitigate and/or obviate the afore-described disadvantages of the conventional cigars.

SUMMARY OF THE INVENTION

The primary objective of the present invention is to provide a cutter for cutting off the distinguished end of the cigar.

In accordance with one aspect of the invention, there is provided a cigar cutter comprising a pair of plates secured together, the plates each including a center orifice for engaging with a cigar, the plates including a pieripheral portion having a pivot shaft provided therein, and a cutting blade engaged between the plates and pivotally coupled to the plates at the pivot shaft, the cutting blade including a cutting edge, the cutting blade being rotated about the pivot shaft for opening the orifices of the plates and for allowing the cigar to engage into the orifices, and the cutting edge of the cutting blade being moved across the orifices for cutting the cigar.

At least one pad is secured to the cutting blade for operating the cutting blade. The plates include a notch formed in the peripheral portion for engaging with the pad. The cutting blade is rotatable from a storing position to an outward opening position, the cigar cutter further includes a biasing means for biasing the cutting blade toward the storing position.

The biasing means includes a semi-circular stop member secured to the peripheral portion of the plates and having an extension extended therefrom for engaging with the cutting blade and for biasing the cutting blade toward the storing position.

The extension includes a tip, the blade includes a peripheral portion having a shoulder formed therein for engaging with the tip of the blade and for limiting the rotational movement of the blade relative to the plates.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
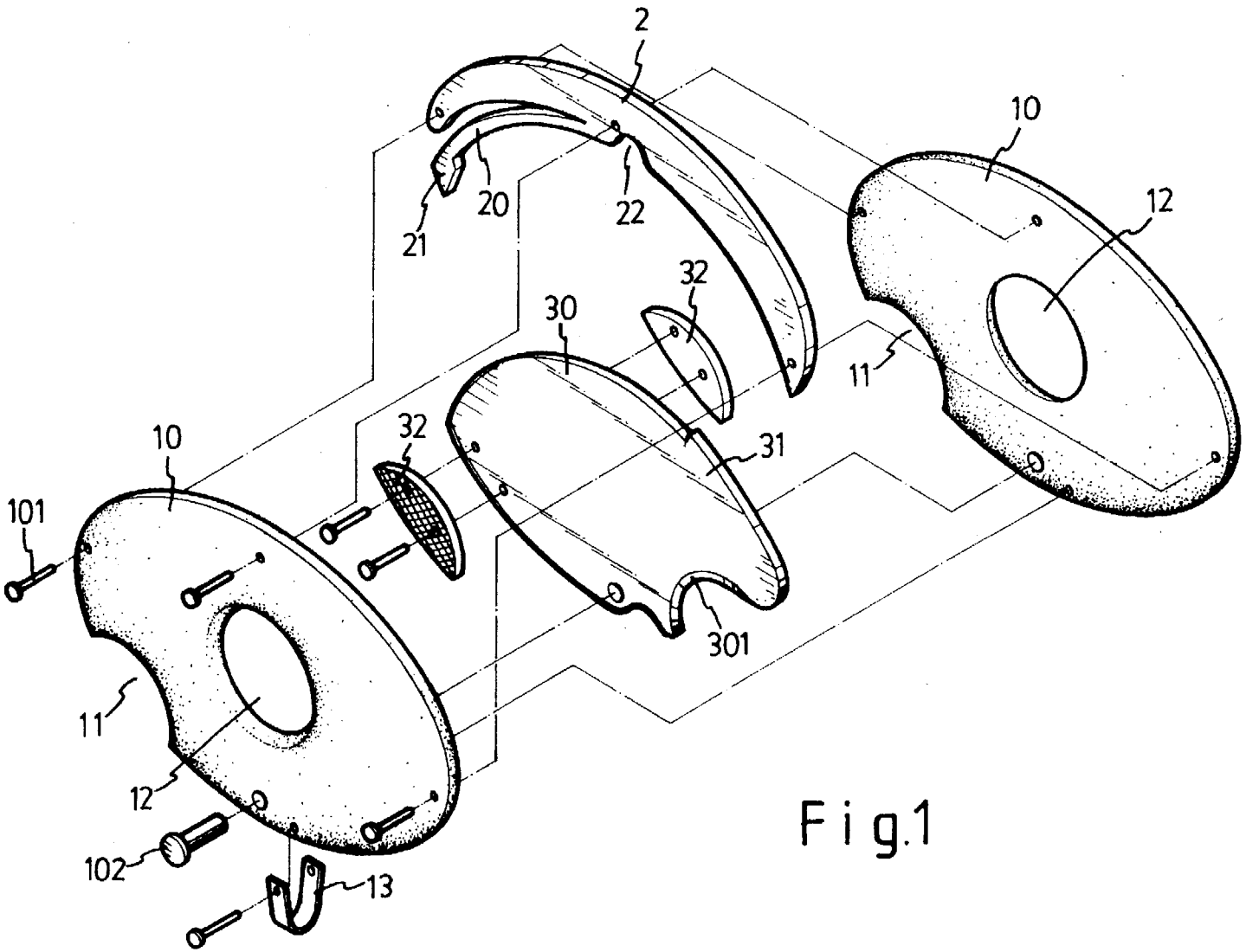
FIG. 1 is an exploded view of a cigar cutter in accordance with the present invention.
Figure 2:
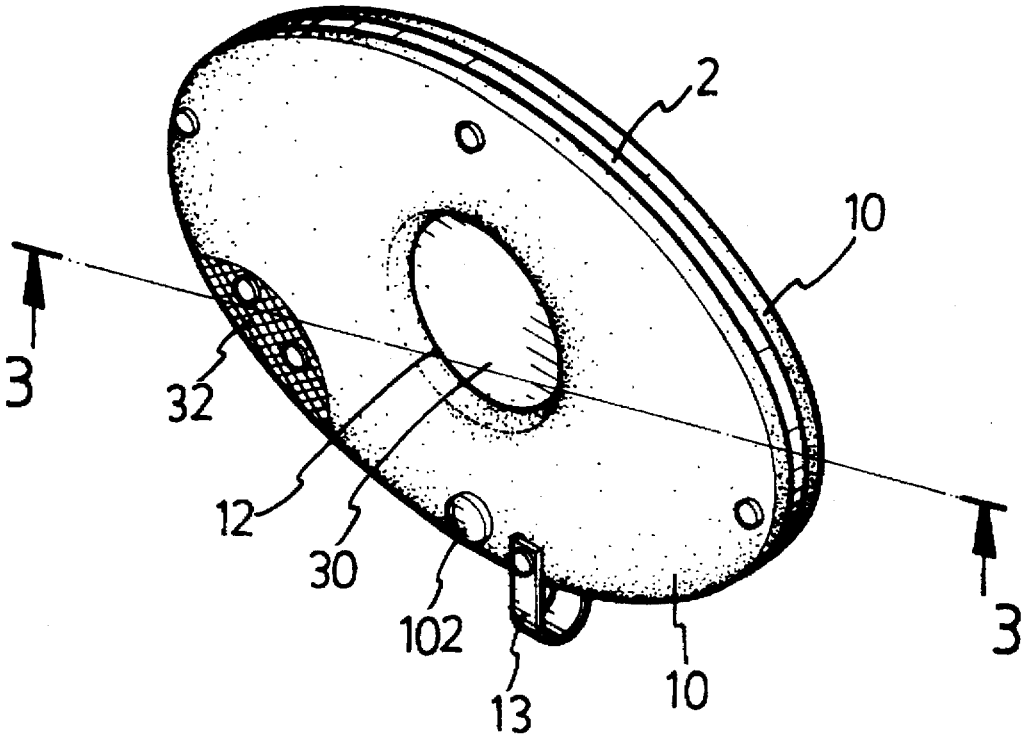
FIG. 2 is a perspective view of the cigar cutter.
Figure 3:
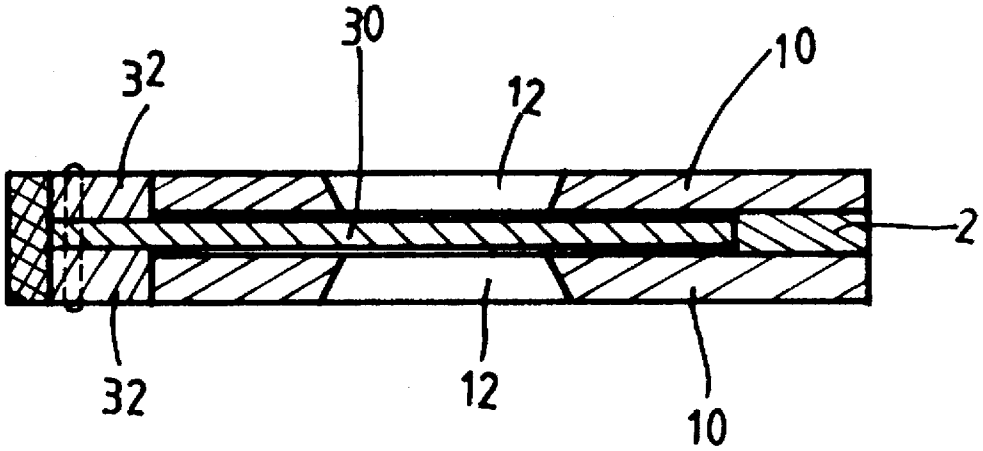
FIG. 3 is a cross sectional view taken along lines 3—3 of FIG. 2.

Referring to FIGS. 1–3, a cigar cutter in accordance with the present invention comprises a housing including two circular plates 10 secured together by fastening members 101. An ear 13 is secured to the housing 10 for allowing the housing 10 to be hung up on a nail or the like. The plates 10 each includes a center orifice 12 and a notch 11 formed in the peripheral portion. A substantially semi-circular stop member 2 is secured to the peripheral portion of the plates 10 and secured between the plates 10. The stop member 2 includes an extension 20 extended from the center portion thereof. The extension 20 includes a tip 21. A depression 22 is formed in the root portion of the extension 20 for increasing the resilience of the extension 20.

A blade 30 is pivotally secured between the plates 10 at a pivot shaft 102 which is located in the peripheral portion of the plates 10. The blade 30 is rotatable about the pivot shaft 102. The blade 30 includes a peripheral portion for engaging with the extension 20 so as to be biased by the extension 20 (FIGS. 4 and 5), and includes a cutting edge 301 formed therein. The blade 30 includes a shoulder 31 formed in the peripheral portion for engaging with the tip 21 of the extension 20 so as to limit the rotational movement of the blade 30 relative to the plates 10 and so as to prevent the cutting edge 301 from moving outward of the plates 10. A pair of pads 32 are secured to the blade 30 and engaged in the notches 11 of the plates 10 such that the user may easily rotate the blade 30 about the pivot shaft 102 by grasping the pads 32.

Figure 4:
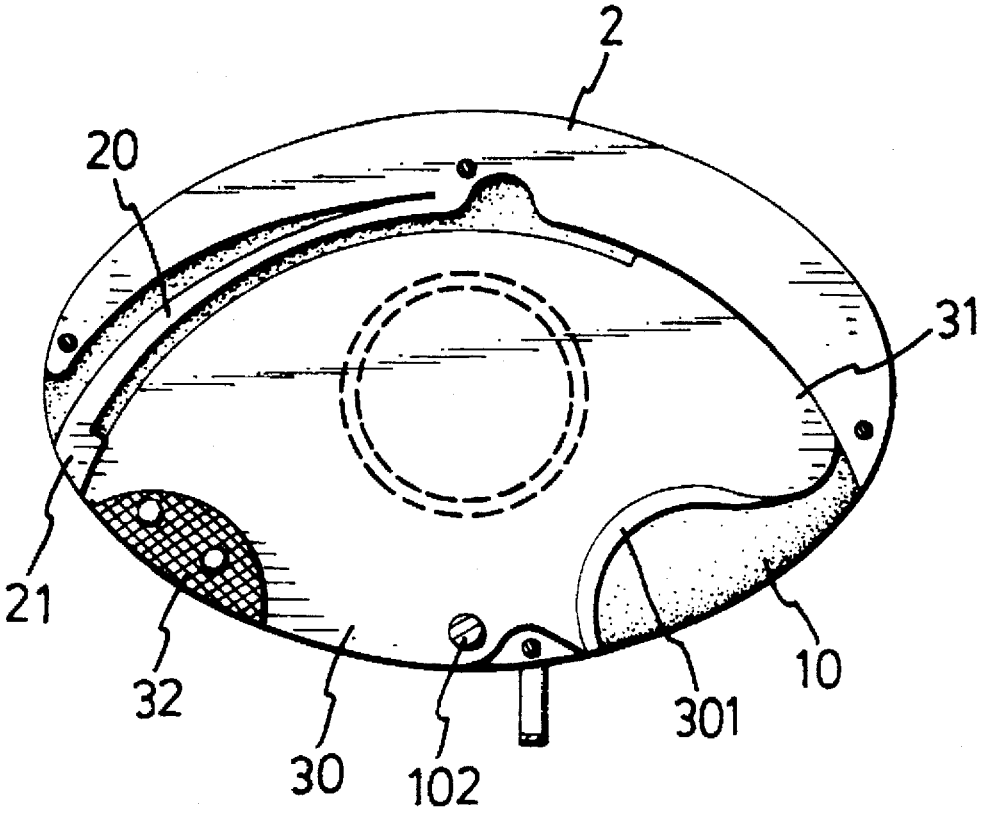
FIGS. 4 and 5 are perspective views illustrating the operation of the cigar cutter.
Figure 5:
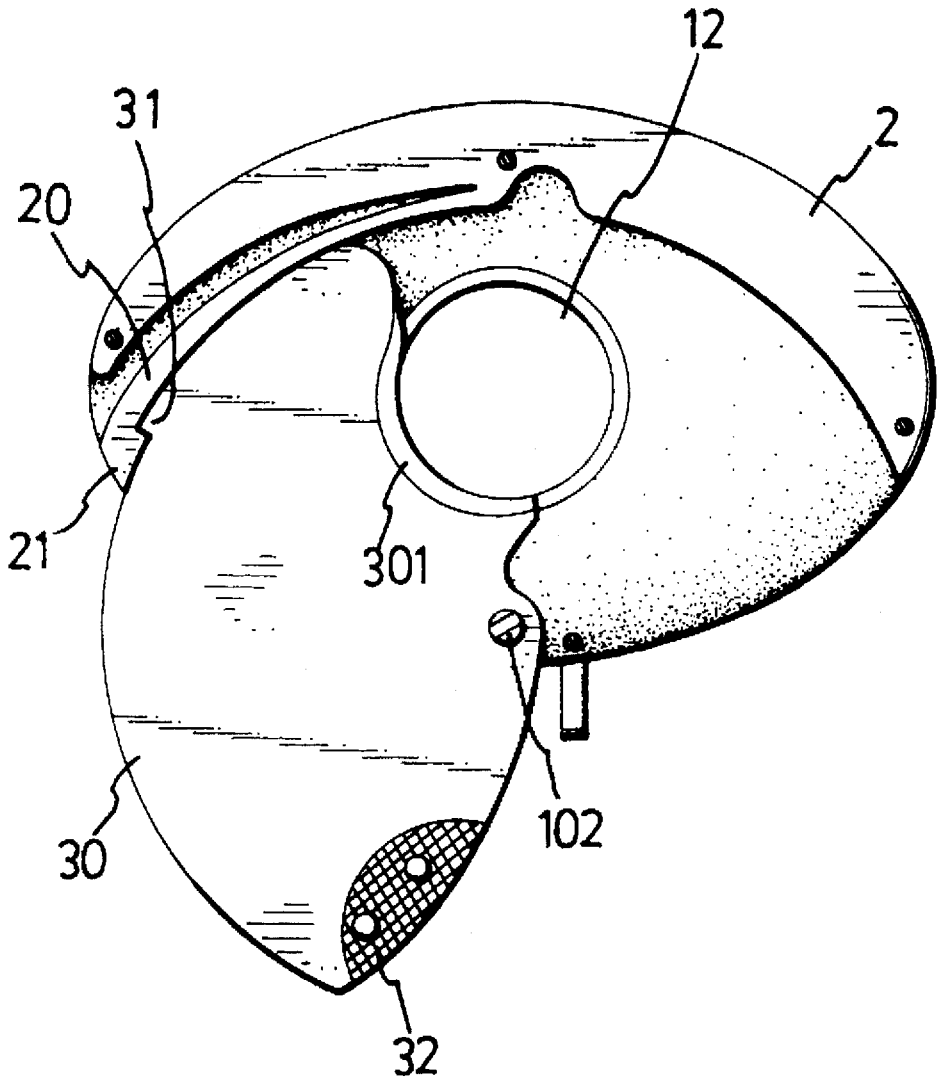

In operation, the extension 20 may apply a resilient force against the blade 30 for biasing the blade 30 to the storing position as shown in FIGS. 2 to 4. At this moment, the center orifices 12 of the plates 10 are blocked by the blade 30. However, as shown in FIG. 5, the blade 30 may be rotated about the pivot shaft 102 to an outward opening position by pulling the pads 32 until the cutting edge 301 is disengaged from the orifices 12 of the plates 10. At this moment, the end of the cigar may be engaged through the orifices 12 of the plates 10 and may be cut by the cutting edge 301 when the blade 30 is rotated or biased backward to the storing position.

Accordingly, the cutter in accordance with the present invention includes a rotatable cutting blade that may easily cut the end portion of the cigar.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cigar cutter comprising:

a pair of plates secured together, said plates each including a center orifice for engaging with a cigar, said plates including a peripheral portion having a pivot shaft provided therein, and a cutting blade engaged between said plates and pivotally coupled to said plates at said pivot shaft, said cutting blade including a cutting edge, at least one pad secured to said cutting blade for operating said cutting blade, said plates including a notch formed in said peripheral portion for engaging with said pad, said cutting blade being rotated about said pivot shaft for opening said orifices of said plates and for allowing the cigar to engage into said orifices, and said cutting edge of said cutting blade being moved across said orifices for cutting the cigar.

2. A cigar cutter according to claim 1, wherein said cutting blade is rotatable from a storing position to an outward opening position, said cigar cutter further includes a biasing means for biasing said cutting blade toward said storing position.

3. A cigar cutter according to claim 2, wherein said biasing means includes a semi-circular stop member secured to said peripheral portion of said plates and secured between said plates, said stop member includes an extension extended therefrom for engaging with said cutting blade and for biasing said cutting blade toward said storing position.

4. A cigar cutter according to claim 3, wherein said extension includes a tip, said blade includes a peripheral portion having a shoulder formed therein for engaging with said tip of said blade and for limiting the rotational movement of said extension relative to said plates.

* * * * *